US005653617A

United States Patent [19]

Seidler

[11] Patent Number: 5,653,617

[45] Date of Patent: Aug. 5, 1997

[54] SMART CARD CONNECTOR

[75] Inventor: Jack Seidler, Flushing, N.Y.

[73] Assignee: North American Specialties Corporation, Flushing, N.Y.

[21] Appl. No.: 496,136

[22] Filed: Jun. 28, 1995

Related U.S. Application Data

[63] Continuation of Ser. No. 186,902, Jan. 25, 1994, abandoned.

[51] Int. Cl.[6] ..... H01R 4/02

[52] U.S. Cl. ..... 439/876

[58] Field of Search ..... 439/83, 876, 638, 439/654

[56] References Cited

U.S. PATENT DOCUMENTS

| | | | |
|---|---|---|---|
| 4,820,173 | 4/1989 | Thom et al. | 439/79 |
| 4,884,983 | 12/1989 | Morrison | 439/876 |
| 4,900,279 | 2/1990 | Dennis | 439/876 |
| 4,932,876 | 6/1990 | Seidler | 439/876 |
| 5,139,448 | 8/1992 | Seidler | 439/876 |
| 5,246,391 | 9/1993 | Seidler | 439/876 |
| 5,344,343 | 9/1994 | Seidler | 439/876 |
| 5,411,420 | 5/1995 | Dennis | 439/876 |
| 5,441,429 | 8/1995 | Seidler | 439/876 |
| 5,441,430 | 8/1995 | Seidler | 439/876 |
| 5,472,349 | 12/1995 | Dixon et al. | 439/79 |

*Primary Examiner*—David L. Pirlot
*Assistant Examiner*—Brian J. Biggi
*Attorney, Agent, or Firm*—Darby & Darby

[57] ABSTRACT

A connector for substrates such as smart cards has a housing containing two parallel rows of spring contacts, each of which is held in a respective channel of the housing. Integral with each of the spring contacts and extending outside of one end of the housing is a terminal lead for connection to a substrate. The lead has a solder mass adjacent its end. The two parallel rows of solder-bearing leads will straddle and resiliently hold a substrate between them to improve accuracy in soldering during solder re-flow. The other end of the housing is provided with entry apertures for pins of a multi-pin connector, so that each pin will enter a respective housing channel to contact the spring contact therein. The entry apertures may accommodate a substrate with contact pads.

16 Claims, 3 Drawing Sheets

SMART CARD CONNECTOR

This application is a continuation of parent application, Ser. No. 08/186,902, filed Jan. 25, 1994, now abandoned.

FIELD OF THE INVENTION

This invention relates to multiple-contact connectors for use with electronic circuit boards, chips, chip carriers and the like.

BACKGROUND OF THE INVENTION

In the electronic industry, an important factor is the rapid and accurate assembly of leads, terminals and contacts with the contact pads of printed circuit boards or other substrates. For convenience of connecting such elements, it has previously been suggested to facilitate the soldering of their connection by securing a solder slug or mass to one of the elements so that, when positioned in engagement with the other element and heated, the molten solder will cover the adjacent surfaces of both elements to form, when cooled, a soldered joint providing both a mechanical coupling and an electrical connection between the elements. Various arrangements of solder-holding elements are disclosed in Seidler U.S. Pat. Nos. 4,120,558, 4,203,648, 4,679,889 and 5,052,954 in each of which a lead has a finger or tab struck from it holding a solder mass to the lead.

As the art has progressed, there has been an increasing need for connectors between various types of devices, such as recent developments in "smart cards" which generally include a credit-card-sized substrate including integrated circuit elements which can be repeatedly reprogrammed to alter the stored information on the card. These integrated circuits are connected to terminals (i.e., contact pads) on the faces or edges of the smart card. Many uses have been suggested for these smart cards, including bank cards that include not only account identification information, but also current balance information or the like.

There is therefore a need for easily connecting a smart card or the like having exposed contact pads, to other circuit elements which would be responsible for reading and recording or otherwise processing the information stored on the card. One type of connector that could be adapted for use with a smart card is the edge clip connector shown in FIG. 10 of Seidler U.S. Pat. Nos. 4,679,889, 4,728,305 which shows a device for permitting connecting a plug-in printed circuit board to another substrate by surface mounting. This connection includes a multiple-contact circuit board edge connector having a housing in which are mounted spring contacts for separable connection to contact pads on a circuit board when inserted. Extending from the bottom of the housing and integral with the individual spring contacts are leads which are bent outwardly at a right angle from the spring contacts so that the connector may be surface mounted to a substrate that is in a perpendicular relationship with the circuit board. The terminal end of each spring contact is formed to carry a solid solder mass, which is placed in register with a respective contact pad of the substrate and soldered to it by usual IR or vapor soldering techniques. Alternatively, the solder mass was omitted, and paste solder and flux applied to the contact pads before aligning the connector terminal ends.

There are significant drawbacks to this configuration, however. First, not all components are intended to be surface mounted, and in certain space configurations, surface mounting would be impossible. Second, since the two solder-bearing terminals of the connector are both contacting the same surface of the substrate and are essentially resting on the substrate, it is necessary to accurately hold the leads with respect to the contact pads on the substrate during soldering to prevent improper soldered connections.

SUMMARY OF THE INVENTION

In view of the deficiencies in the prior art noted above, it is an object of the invention to provide a connector for separably attaching a multi-pin plug connector or printed circuit board or similar substrate to another substrate (such as a smart card) in generally parallel or aligned relationship to the connector.

It is another object of the invention to provide a connector that will resiliently retain the connector on the substrate during soldering to improve retaining the proper positioning thereof.

It is a further object of the invention to provide a connector useful for coupling smart cards, circuit boards or other substrates to external circuits, and which is simple and cost effective to manufacture.

In accordance with the objects of the invention, a connector is provided having a housing. One or more parallel sets of spring contacts are retained in the housing. The housing may have an open end into which a circuit substrate having bare contact pads may be inserted to contact the spring contacts. Alternatively, a multi-pin plug connector may be inserted into the housing open end. Integral with each of the spring contacts but extending outside of the housing is a solder-bearing terminal for connection to another substrate. Preferably two parallel rows of solder-bearing leads are used which straddle and hold a substrate between them with a resilient force during soldering to improve accuracy and reliability in soldering.

BRIEF DESCRIPTION OF THE DRAWINGS

The above mentioned and other objects, advantages and embodiments of the present invention will become apparent to those skilled in the art from the following description of the preferred embodiments in conjunction with a review of the appended drawings, in which.

DETAILED DESCRIPTION OF THE PREFERRED EMBODIMENTS

Figure 1:
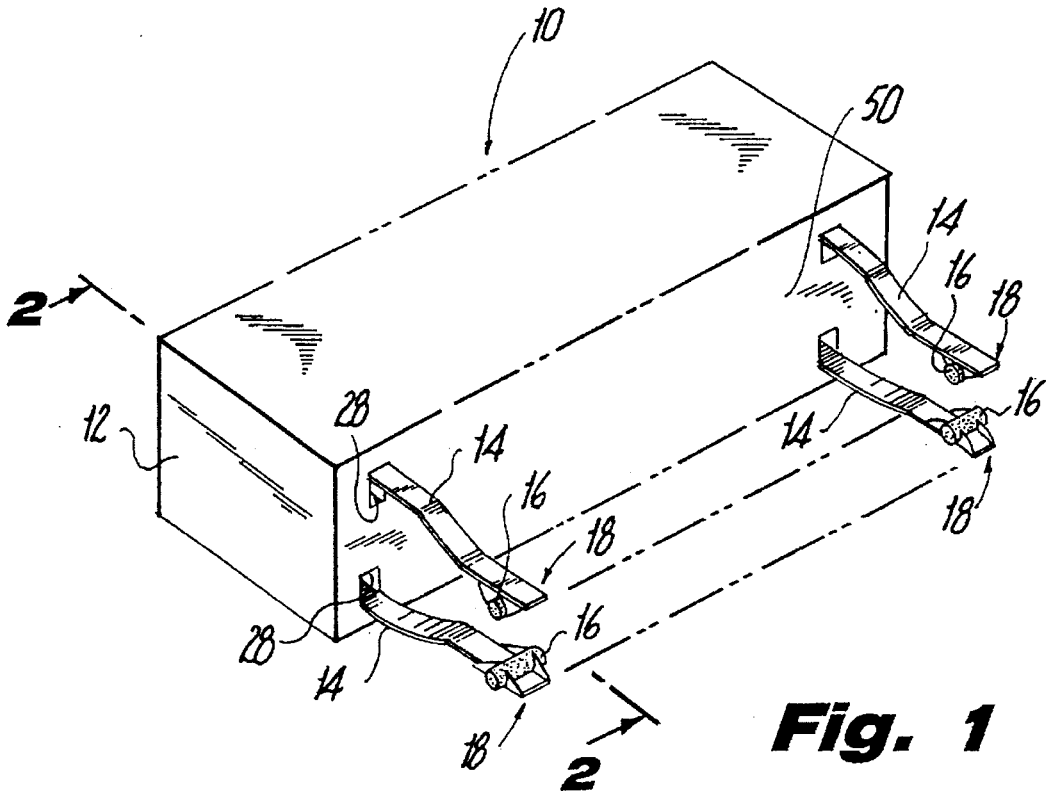
FIG. 1 is a perspective view of a connector according to the present invention.

Referring now to the drawings, FIG. 1 shows a connector 10 including an outer housing 12. The housing is preferably formed of a non-conductive material, such as plastic, and may be preformed or molded. Extending from the housing are two parallel rows of conductive resilient leads 14 each of which is solder-bearing at or near its end or terminal with a solder slug or solid mass 16 held firmly to the lead. In the preferred embodiments, the solder is held near the distal end 18 of each of the individual leads 14.

As can be seen in FIG. 1, the solder is held to each individual lead on the surface that faces an opposite lead 14. This will allow any substrate 20 inserted between the two sets of leads 14 to be resiliently held between the leads with the solder abutting the surfaces of substrate 20. The leads 14 are spaced to be located in registry with conductive pads on the substrate 20, and to straddle the substrate. The overall length of the connector 10, the number of leads 14 and the spacing between the leads is correlated to each particular substrate, is dependent on the length of the substrate 20, and the number of and spacing between the corresponding contact pads 22 on the surfaces of the substrate 20.

Figure 2:
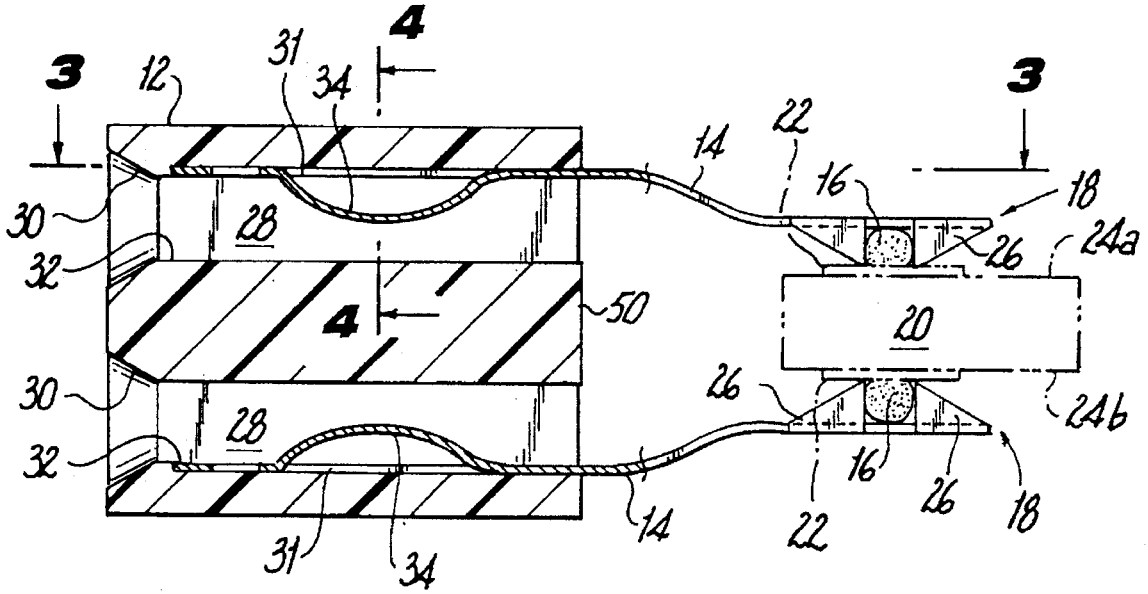
FIG. 2 is a transverse cross-section of the connector of FIG. 1 along line 2—2 thereof.

As can be seen in FIG. 2, the solder mass 16 on each lead 14 abuts a corresponding contact pad 22 on one of the two opposing surfaces 24*a*, 24*b* of the substrate 20. Although in the preferred embodiment the solder 16 is held in place by triangular tabs 26 that are bent up from the sides of the leads 14 and indented into the solder masses 16, as is shown in prior U.S. Pat. No. 4,728,305 it is to be understood that any known method of attaching the solder masses 16 to the leads 14 is contemplated by the present invention. If contact pads 22 are present on only one of the two surfaces of the substrate 24*a*, 24*b*, it is contemplated that respective non-conductive plugs may be substituted for the solder masses 16 in the other set of the leads 14.

The housing 12 includes a plurality of channels 28 each of which includes a tapered opening 30 (e.g., a frustum of a pyramid) opposite the end from which its respective lead 14 extends. Individual spring contacts 31 are mounted within the respective channels against the walls 32 of the channels.

Figure 3:
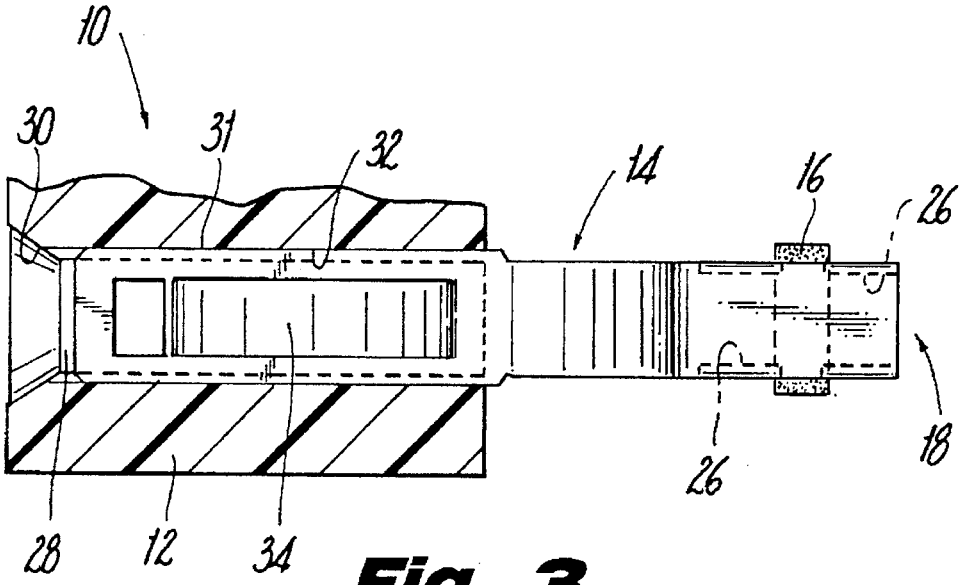
FIG. 3 is a fragmentary elevation cross-sectional view taken along line 3—3 of FIG. 2.
Figure 4:
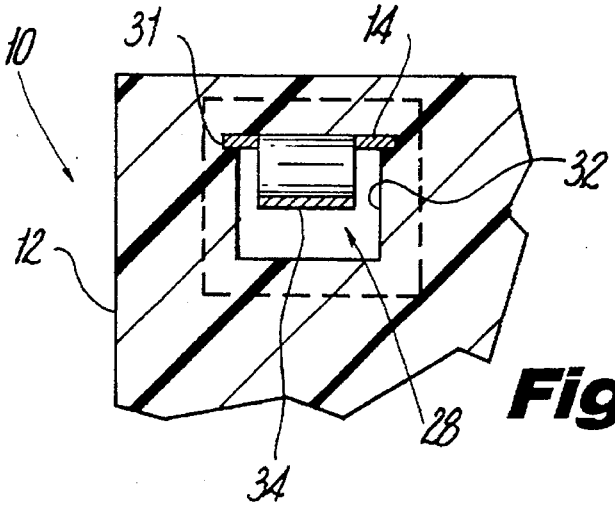
FIG. 4 is a fragmentary elevation cross-sectional view taken along line 4—4 of FIG. 2.

As seen in FIGS. 2, 3 and 4, each of spring contacts 31 preferably has a curved finger 34 struck out from a mid-portion of the contact 31, with finger 34 extending inward from the walls 32 into channel 28. Each of the apertures 30 and channels 28 will receive a pin of a dual row multi-pin connector to be coupled to the smart card or other substrate. Since each pin will have a width similar to that of the channels 28, the finger 34 will flex and contact the pin resiliently. Each finger 34 is bowed, with its distal end at or near the wall of the housing, so that upon insertion of a mating element (e.g., a pin) into channel 28, the contact finger 34 forms a double-ended cantilever spring. The contacts 31 are prevented from moving away from the walls 32 in any suitable manner, such as by being molded in place or secured in grooves in the side wall of channel 28.

Figure 5:
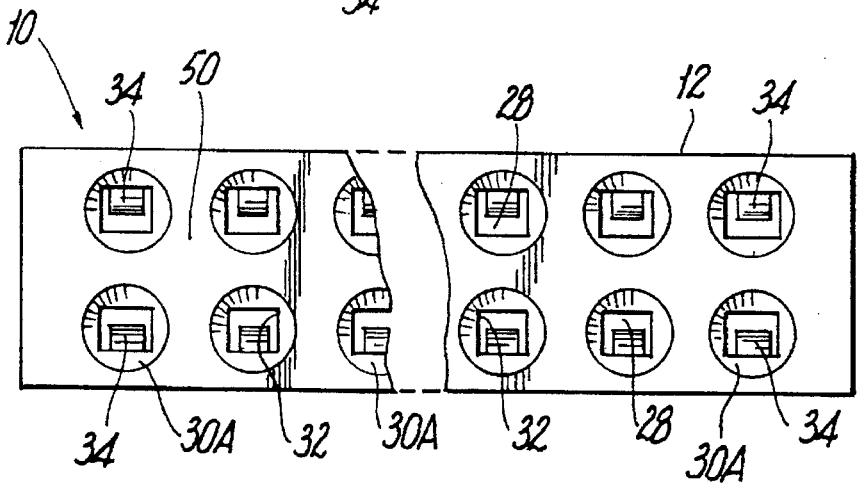
FIG. 5 is a front elevational view of the device of FIG. 1 adapted to receive a dual row, multi-pin connector.

FIG. 5 shows a modification of the device of FIGS. 1–4, where the openings 30A are made frustro-conical to guide pins of the mating multi-pin plug into engagement with spring contacts 31.

Figure 6:
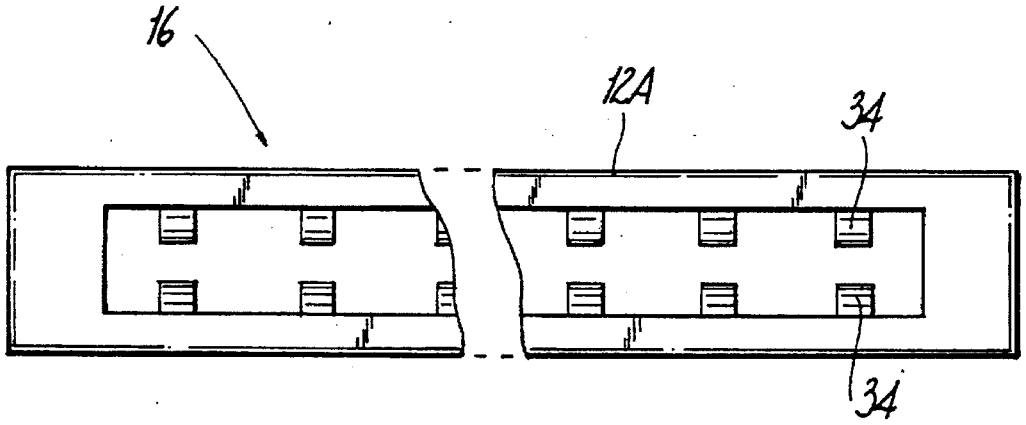
FIG. 6 is a front elevational view of a modified form of the device of FIG. 1 adapted to receive a substrate with contact pads registering with the spring contacts.

FIG. 6 shows a modification in which the housing 12A is adapted to receive a substrate with contact pads in register with the spring contacts 34. In this instance, the central partition 50 shown in FIG. 2 is omitted, The contacts B4 are held in the housing 34A and have terminals 14 in the same way as in FIGS. 1–4.

Figure 7:
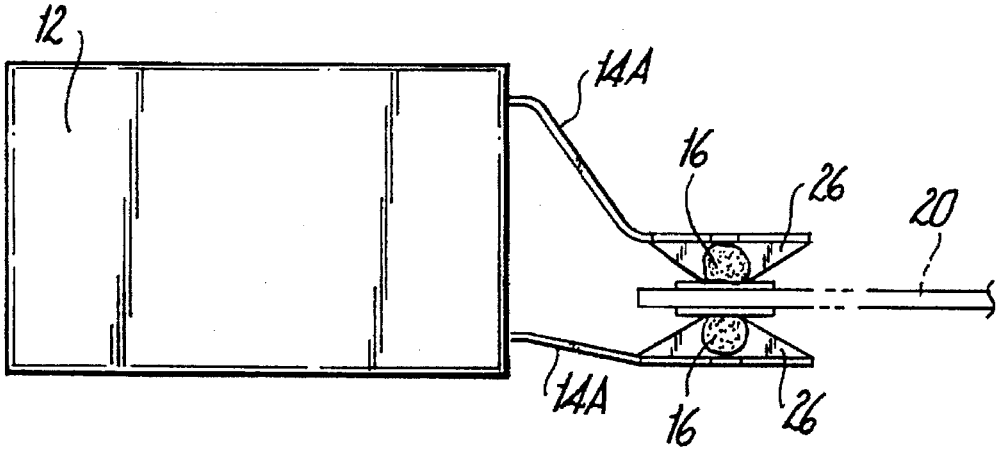
FIG. 7 is a side elevational view of a modification of the devices of FIGS. 1–4, 5 and 6.

As seen in FIG. 2, the contacts 31 and leads 14 are in a generally aligned arrangement without any significant angles along their length. This allows the terminals 14 to straddle over a smart card 20 generally along the plane of the smart card. Where desired, the leads 14 may be offset as shown in FIG. 7 so that the smart card 20 with leads 14 and connector 10 may rest on the same planar surface.

Figure 8:
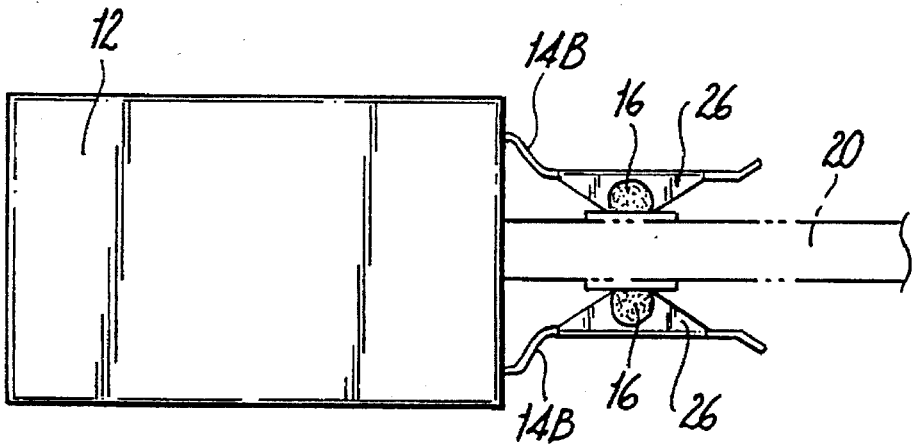
FIG. 8 is a side elevation view of another modification of the present invention.

While FIG. 2 shows a square tapered entry 30 for the mating pins, it will be understood that circular tapered entries may be used if desired, as shown in FIG. 5. The "straddle termination" of FIGS. 1–4 may also be a central one, with minimal length of terminals 14B, as seen in FIG. 8.

Thus, it can be seen that a connector is provided for securing to a substrate and for releasably connecting a multi-pin connector or another circuit board to the substrate (e.g., a smart card or the like), in a generally aligned or parallel relationship. Further, the construction and positioning of the leads 14 causes the substrate 20 to be resiliently held between them during soldering, thereby facilitating reliable soldering.

The objects and the advantages of the present invention are achieved by the embodiments shown and described. It is to be understood that these embodiments are shown and described solely for the purpose of illustration, and not for purpose of limitation, the present invention being limited only by the following claims.

What is claimed as the invention is:

1. A connector for soldered connection to a substrate having contact pads on at least one surface thereof, comprising:

a housing, said housing having at least two channels and including a base portion along a first wall of each channel and a bowed finger extending from the base at one of its ends, the other end slidably engaging the first wall therein each adapted to receive a mating contact element;

a conductive spring contact mounted within each of said channels and adapted to connect to a mating element when the element is inserted in a respective channel and to maintain said mating element between said spring contact and said housing;

a resilient terminal integral with and generally in alignment with a respective one of said spring contacts, said terminal having solid mass of solder held thereto at a point adjacent its end;

at least two of said terminals being arranged in opposing relationship, with said respective solder masses facing each other and spaced in their unstressed state by a distance less than the thickness of said substrate, whereby said terminals will resiliently straddle and retain a substrate therebetween during soldering of said terminals to said substrate contact pads.

2. A connector as in claim 1, wherein said mating contact element is a pin of a pin connector.

3. A connector as in claim 1, wherein said mating contact element is a contact pad on a substrate.

4. A connector as in claim 1, wherein each of said spring contacts comprises a contact body and a finger struck from said contact body, said finger extending at least partially away from said contact body and the walls of its respective channel.

5. A connector as in claim 1, wherein said channels are adapted to receive a dual-row multi-pin connector for connection to said spring contacts.

6. A connector as in claim 1, wherein said opposed terminals are offset from a center line of said housing.

7. A connector as in claim 1, wherein said solder masses are adjacent said housing.

8. A connector as in claim 1, wherein each said spring contact portion is a finger joined at one end integrally to said contact and having a free end.

9. A connector as in claim 8, wherein said finger is bowed and its free end is adjacent a wall of said housing.

10. A connector for a substrate having contact pads on at least one surface area thereof, comprising a housing having a channel including a base portion along a first wall and a bowed finger extending from the base at one of its ends, the other end slidably engaging the first wall, said channel adapted to receive said substrate, a plurality of conductive spring members mounted within said channel and spaced in correspondence with the spacing of said contact pads each said spring member adapted to maintain a mating element between said spring member and said housing, said spring members being arranged in two parallel rows with each of the spring members in one row being opposite to a corresponding spring member in the other row, each spring member having integrally formed therewith a resilient terminal portion generally in alignment with its respective spring contact, a mass of solid solder held on each of said terminal portions in at least one of said rows at a point adjacent to its end, and with the respective terminal portions facing each other and spaced in their unstressed state by a distance less than the thickness of a second substrate to be soldered thereto, whereby said terminal portions will resiliently straddle and retain said second substrate therebetween during soldering of said solder-bearing terminal portions to said second substrate.

11. A connector for soldered connection to a substrate having contact pads on at least one surface thereof, comprising a housing, said housing having at least one channel including a base portion along a first wall of said channel and a bowed finger extending from the base at one of its ends, the other end slidably engaging the first wall, said channel therein adapted to receive a mating contact element;

said housing having a groove in a wall of at least one said channel, a flat conductive spring contact mounted within at least one of said grooves and having an integral portion extending within its respective channel said spring contact adapted to maintain a mating element between said spring contact and said housing, said portion being adapted to contact a mating element when said element is inserted in a respective channel, a resilient terminal integral with and generally in alignment with at least one said spring contact, said terminal having a solid mass of solder held thereto at a point adjacent its end;

at least two of said terminals being arranged in opposing relationship, with said respective solder masses facing each other and spaced in their unstressed state by a distance less than the thickness of said substrate, whereby said terminals will resiliently straddle and retain a substrate therebetween during soldering of said terminals to said substrate contact pads.

12. A connector for soldered connection to a substrate having contact pads on at least one surface thereof, comprising a housing, said housing having at least one channel including a base portion along a first wall of said channel and a bowed finger extending from the base at one of its ends, the other end slidably engaging the first wall, said channel therein adapted to receive a mating contact element;

said housing having a groove in a wall of at least one said channel, a flat conductive spring contact mounted within at least one of said grooves and having an integral portion extending within its respective channel said spring contact adapted to maintain a mating element between said spring contact and said housing, a first resilient terminal integral with and generally in alignment with said spring contact, said terminal having a solid mass of solder held thereto adjacent its end, a second terminal integral with and generally in alignment with a different one of said spring contacts, said first and second terminals being arranged in opposing relationship with the solder mass of one terminal facing the other terminal, said terminals being spaced in their unstressed state by a distance less than the thickness of said substrate, whereby said terminals may resiliently straddle and retain said substrate therebetween during soldering of said first terminal to said substrate pads.

13. The connector as in claim 12 wherein at least some of said second terminals have an insulating element held thereto at a point adjacent its end, said first and second terminals being arranged in opposing relationship with the solder mass of one terminal facing the insulating element on another terminal.

14. A connector for a substrate having contact pads on at least one surface area thereof, comprising a housing having a channel and including a base portion along a first wall of said channel and a bowed finger extending from the base at one of its ends, the other end slidably engaging the first wall, said channel adapted to receive said substrate, said channel having a pair of opposed walls, a plurality of grooves formed in said walls, and spaced in correspondence with the spacing of said pads, each said groove in one wall being opposed to a respective groove in the other wall, a plurality of conductive spring contacts each mounted within a respective groove each said spring contact adapted to maintain a mating element between said spring contact and said housing, each contact having an integral portion extending into said channel for contact with a respective pad of said substrate when said substrate is inserted in said channel, each spring contact having integrally formed therewith a resilient terminal generally in alignment with its respective spring contact, said spring contacts and terminals being arranged in two parallel rows with each of the spring contacts and terminals in one row opposite to a corresponding spring terminal and contact in the other row, and spaced in their unstressed state by a distance less than the thickness of a second substrate to be soldered thereto, a solid mass of solder held on certain of said terminals of at least one of said rows at a point adjacent to its end, whereby said terminals may straddle and resiliently retain said second substrate therebetween during soldering of said terminals to said second substrate.

15. A connector as in claim 14, wherein each said spring contact portion is a finger joined at one end integrally to said contact and having a free end.

16. A connector as in claim 15, wherein said finger is bowed and its free end is adjacent a wall of said housing.

* * * * *